United States Patent [19]

Bouquet

[11] 3,963,016

[45] June 15, 1976

[54] VALVE CHESTS

[75] Inventor: Jean-Claude Bouquet, Pantin, France

[73] Assignee: Societe d'Etudes de Machines Thermiques - S.E.M.T.E., Saint Denis, France

[22] Filed: Jan. 13, 1975

[21] Appl. No.: 540,503

[30] Foreign Application Priority Data

Jan. 29, 1974 France ..... 74.02899

[52] U.S. Cl. ..... 123/188 S; 123/188 R; 123/189

[51] Int. Cl.[2] ..... F01L 3/00

[58] Field of Search ..... 123/188 R, 188 GC, 188 S, 123/189, 188 UA

[56] References Cited

UNITED STATES PATENTS

| | | | |
|---|---|---|---|
| 2,631,577 | 3/1953 | Carter | 123/188 S |
| 3,046,965 | 7/1962 | Kaufman | 123/188 S |
| 3,165,101 | 1/1965 | Vargyai | 123/188 S |
| 3,385,053 | 5/1968 | Soichirohonda et al. | 123/188 S |
| 3,868,953 | 3/1975 | Roll | 123/188 S |

*Primary Examiner*—Wendell E. Burns
*Assistant Examiner*—David D. Reynolds
*Attorney, Agent, or Firm*—Kenyon & Kenyon Reilly Carr & Chapin

[57] ABSTRACT

An overhead valve chest for an internal combustion engine with a cylindroconical portion adjacent to the bottom seating of the chest within the cylinder-head and comprising a sealing ring overlapping said cylindro-conical portion and mounted in a groove the diameter of the flat horizontal top wall of which adjacent to the conical portion of said chest is larger than that of the lower wall opposite to the cylindrical wall of said chest, said ring being in continuous bearing engagement with its ends inside of said groove.

2 Claims, 1 Drawing Figure

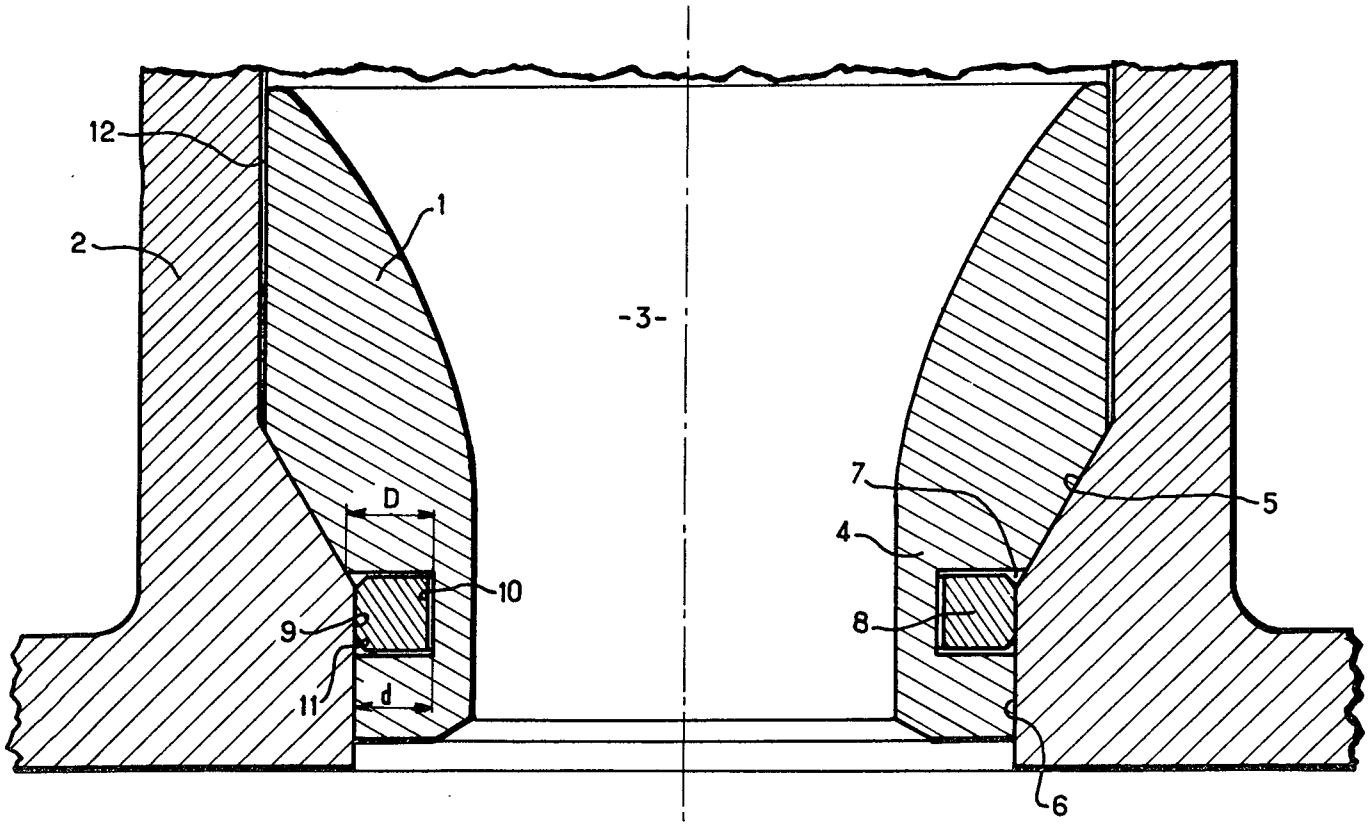
5
6
7
4
8
-3-
10
1
D
d
9
11
12
2

VALVE CHESTS

The present invention relates to improvements in valve chests or boxes for internal combustion engines.

Such chests are mounted in bearing engaging relationship on the cylinder-head of an engine which is generally of the Diesel type. Such chests serve generally for accommodating or housing the overhead valves. It is then very important that the fluid-tightness between the chest and the cylinder-head be achieved in a satisfactory manner.

Thus in the case of an exhaust valve for instance the exhaust gases should be prevented from flowing between the valve chest and the cylinder-head. As a matter of fact the passage of such still hot gases is likely to quickly damage the cylinder-head.

The object of the present invention is to provide an overhead valve chest or box for an internal combustion engine, of the kind having a part of substantially cylindroconical shape at the lower bearing seating of said valve chest within the cylinder-head of said engine, said chest being characterized in that it comprises a sealing ring overlapping said cylindro-conical portion and mounted in a circumferential groove the diameter of the flat top horizontal wall of which at the conical wall of said chest is larger than that of the lower wall located opposite to the cylindrical wall of said chest, said ring and in particular the ring ends being in continuous bearing engagement within said groove.

According to another characterizing feature of the invention, said sealing ring is characterized in that a chamfered or bevelled portion is provided on the outer periphery and at the top and bottom faces of said ring which is then only bearing against the cylindrical wall of said cylinder-head, said bearing engagement being symmetrical with respect to the central horizontal plane of said ring.

The invention will be better understood and further objects, characterizing features, details and advantages thereof will appear more clearly as the following explanatory description proceeds with reference to the accompanying diagrammatic drawing given by way of non-limitative example only illustrating one presently preferred form of embodiment of the invention and wherein:

the single FIGURE is a view in partial axial section through a chest according to the invention mounted in a cylinder-head, said view being shown with parts broken away from the upper portion.

According to the form of embodiment illustrated the valve chest 1 is mounted within a cylinder-head 2, the valve being fitted into the inside 3 of the chest.

This valve exhibits a cylindrical symmetry with respect to an axis of revolution. The lower seat 4 of the chest 1 for seating same in the cylinder-head 2 comprises a conical or tapering portion 5 and a cylindrical portion 6.

A groove 7 is provided adjacent to the bearing seat 4 in overlapping relation to the cylindro-conical portion of the chest 1. A sealing ring 8 is arranged inside of the groove 7. Preferably the ring 8 carries a bevelled or chamfered portion 11 on the periphery of its outer side 9 at the top face of this ring as well as at the bottom face thereof.

The inner face 10 of the ring 8 is located adjacent to the radially inner wall of the groove. The reference numeral 12 designates the small space or clearance gap left between the chest 1 and the cylinder-head 2.

Such a sealing ring 8 proves to be very useful to prevent the gases from escaping through the intermediate space 12. As a matter of fact the tapering or frustoconical portion 5 of engagement between the chest and the cylinder-head may exhibit structural defects and in such a case the fluid-tightness is not satisfactory. The gases may then escape through the clearance gap 12 with the risk of quickly deteriorating the cylinder-head itself.

As stated previously the groove 7 for the ring 8 is overlapping the cylindro-conical portion so that the diameter D of the flat horizontal top wall of the groove 7 is larger than the diameter *d* of the bottom wall of this groove. Thus the groove 7 forms a continuous bearing surface for the whole ring 8 and in particular for the ends of this ring.

This proves to be particularly useful when mounting the chest into the cylinder-head. That portion which is opposite from the ends of the ring may indeed be located for instance entirely adjacent to the radially inner wall of the groove; in such a case the ring ends entirely project radially outwards. When mounting the ring they then meet or abut the conical wall of the chest thereby causing a jamming or blocking action and preventing the ring ends from properly moving into the groove. The operation for mounting the chest into the cylinder-head then becomes very difficult and is practically impossible owing to the bendings of the ring ends.

It is moreover particularly useful to chamfer the ring 8 on either side of its outer surface 9 at the top face of the ring as well as at its bottom face. The sealing ring then indeed bears against the cylindrical wall 6 only. Moreover the bearing portion or engaging surface is then symmetrical with respect to the central horizontal plane of the ring 8. This then avoids any warping of the ring through twisting when mounting the valve chest into the cylinder-head.

Thus according to the invention the operation for mounting the valve chest into the engine cylinder-head is carried out in a particularly satisfactory manner; the fluid-tightness achieved between the valve chest and the cylinder-head is therefore very satisfactory in this case. The exhaust gases then would indeed flow only through the inside space 3 of the valve chest and not through the clearance gap 12 between the valve chest and the cylinder-head.

It should be understood that the invention is not at all limited to the form of embodiment described and shown which has been given by way of example only. In particular it comprises all the means constituting technical equivalents of the means described as well as their combinations if same are carried out according to its gist and used within the scope of the appended claims.

What is claimed is:

1. An overhead valve chest for an internal combustion engine, comprising a portion of cylindro-conical shape adjacent to a lower bearing seat of said valve chest for seating within a cylinder head of the engine said valve chest further comprising an annular groove formed in the said cylindro-conical portion and having a flat upper wall and an opposite flat lower wall, a sealing ring mounted into said groove and having an outer cylindrical surface in continuous bearing engagement on a corresponding inner cylindrical surface of the cylinder head, said groove being formed in overlapping relation to said cylindro-conical portion so that the diameter of the said flat upper wall of the groove is larger than that of the laid flat lower wall of the groove, said larger upper wall being situated on the side of the cylinder head which permits the mounting of the valve chest in the cylinder head, and forming a continuous bearing surface for the sealing ring during the said mounting.

2. An overhead valve chest as in claim 1, wherein the said outer cylindrical surface of the sealing ring is bevelled at the upper and lower edges thereof.

* * * * *

UNITED STATES PATENT AND TRADEMARK OFFICE

CERTIFICATE OF CORRECTION

PATENT NO. : 3,963,016

DATED : June 15, 1976

INVENTOR(S) : Jean Claude Bouquet

It is certified that error appears in the above-identified patent and that said Letters Patent are hereby corrected as shown below:

The name of the Assignee should read - Societe d'Etudes de Machines Thermiques - S.E.M.T. -.

Signed and Sealed this

Second Day of November 1976

[SEAL]

*Attest:*

RUTH C. MASON
*Attesting Officer*

C. MARSHALL DANN
*Commissioner of Patents and Trademarks*